US011306592B2

(12) United States Patent
Spezia et al.

(10) Patent No.: US 11,306,592 B2
(45) Date of Patent: Apr. 19, 2022

(54) REVERSE CYCLE MACHINE PROVIDED WITH A TURBINE

(71) Applicant: SIT TECHNOLOGIES SRL, Genoa (IT)

(72) Inventors: Raffaele Antonio Spezia, Tortona (IT); Alberto Traverso, Novi Ligure (IT); Stefano Barberis, Genoa (IT); Luca Larosa, Genoa (IT); Paolo Silvestri, Genoa (IT)

(73) Assignee: SIT TECHNOLOGIES SRL, Genoa (IT)

( * ) Notice: Subject to any disclaimer, the term of this patent is extended or adjusted under 35 U.S.C. 154(b) by 192 days.

(21) Appl. No.: 16/474,788

(22) PCT Filed: Dec. 27, 2017

(86) PCT No.: PCT/EP2017/084660
§ 371 (c)(1),
(2) Date: Jun. 28, 2019

(87) PCT Pub. No.: WO2018/127445
PCT Pub. Date: Jul. 12, 2018

(65) Prior Publication Data

US 2019/0323350 A1 Oct. 24, 2019

(30) Foreign Application Priority Data

Jan. 4, 2017 (IT) ..... 102016000132467

(51) Int. Cl.
*F25B 11/04* (2006.01)
*F01D 1/36* (2006.01)
*F01D 15/00* (2006.01)

(52) U.S. Cl.
CPC ..... *F01D 1/36* (2013.01); *F01D 15/005* (2013.01); *F25B 11/04* (2013.01);
(Continued)

(58) Field of Classification Search
CPC ..... F01D 1/36; F01D 15/005; F25B 11/04; F05D 2260/602; F04D 5/001; F04D 29/70; F04D 29/706; F04D 29/708
See application file for complete search history.

(56) References Cited

U.S. PATENT DOCUMENTS 1,061,206 A 5/1913 Tesla
4,336,693 A 6/1982 Hays et al.
(Continued)

FOREIGN PATENT DOCUMENTS

CN 203131996 U 8/2013
EP 076600 A2 10/1995
(Continued)

OTHER PUBLICATIONS

International Preliminary Report on Patentability dated Mar. 22, 2019 re: Application No. PCT/EP2017/084660; pp. 1-15; citing: U.S. Pat. No. 4,438,638 A, US 2016/0258442 A1, KR 2013 0128903 A, WO 01/46564 A1, WO 2015/200134 A1, US 2012/014779 A1 and EP 1 067 342 A2.
(Continued)

*Primary Examiner* — Richard A Edgar
(74) *Attorney, Agent, or Firm* — Cantor Colburn LLP

(57) ABSTRACT

A reverse compression cycle machine includes an evaporator, a compressor and a condenser arranged in series along a path of a working fluid in the machine, further including a boundary layer turbine placed between the condenser and the evaporator. The turbine includes a set of power disks mounted on a shaft which rotates inside a volume of a rotor casing, an inlet opening for introducing a working fluid in a stator volume, a stator nozzle, which accelerates the flow in a direction that is tangential to the power disks, and a discharge of a working fluid. The rotor casing includes a drain of a liquid fraction of the working fluid from the peripheral part of the power disks in order to avoid its
(Continued)

concentration in the peripheral part of the volume of the rotor casing.

7 Claims, 4 Drawing Sheets

(52) U.S. Cl.
CPC ..... *F05D 2210/13* (2013.01); *F05D 2240/55* (2013.01); *F05D 2260/602* (2013.01); *F25B 2400/0411* (2013.01); *F25B 2400/141* (2013.01)

(56) References Cited

U.S. PATENT DOCUMENTS

| | | | | |
|---|---|---|---|---|
| 4,438,638 | A * | 3/1984 | Hays | F01D 1/32 60/651 |
| 4,442,682 | A * | 4/1984 | Sakata | F25B 11/02 415/203 |
| 6,682,077 | B1 | 1/2004 | Letourneau | |
| 2012/0014779 | A1 | 1/2012 | Gilliam | |
| 2013/0294890 | A1 | 11/2013 | Cepeda-Rizo et al. | |
| 2016/0258442 | A1* | 9/2016 | Helton | F04D 29/444 |

FOREIGN PATENT DOCUMENTS

| | | | |
|---|---|---|---|
| EP | 0728996 | A2 | 8/1996 |
| EP | 1067342 | A2 | 1/2001 |
| KR | 20130128903 | A | 11/2013 |
| WO | 0146564 | A1 | 6/2001 |
| WO | 2015200134 | A1 | 12/2015 |

OTHER PUBLICATIONS

International Search Report dated Feb. 29, 2018 re: Application No. PCT/EP2017/084660; pp. 1-5; citing: U.S. Pat. No. 4,438,638 A, US 2016/0258442 A1, KR 2013 0128903 A, WO 01/46564 A1, WO 2015/200134 A1, US 2012/014779 A1 and EP 1 067 342 A2.

IT Search Report dated Aug. 21, 2017 re: Application No. IT 2016000132467; pp. 1-3; citing: US 2016/0258442 A1, WO 01/46564 A1, WO 2015/200134 A1, U.S. Pat. No. 6,682,077 B1 and US 2012/014779 A1.

Written Opinion dated Feb. 29, 2018 re: Application No. PCT/EP2017/084660; pp. 1-6; citing: U.S. Pat. No. 4,438,638 A, US 2016/0258442 A1, KR 2013 0128903 A, WO 01/46564 A1, WO 2015/200134 A1, US 2012/014779 A1 and EP 1 067 342 A2.

* cited by examiner

REVERSE CYCLE MACHINE PROVIDED WITH A TURBINE

TECHNICAL FIELD

The present disclosure relates to the field of reverse cycles, particularly to the improvement of the performance of refrigeration systems or compression heat pumps which utilize the phase transition, both evaporation and condensation, of a working fluid in a closed circuit.

The disclosure relates in particular to a device for energy recovery of the pressure difference between the condenser and the evaporator of the above-cited reverse cycles, which is commonly dissipated in adapted ducts having a reduced passage section or in throttling valves.

The disclosure finds a preferred and advantageous but nonlimiting application in the refrigeration industry, in order to reduce the energy consumption of compression refrigeration systems, for example those of industrial size (>100 kW electric power) or of domestic size (<10 kW electric power).

BACKGROUND

Solutions for energy recovery in refrigeration systems and heat pumps are known in the background art.

Refrigeration systems and heat pumps are also referred to as reverse cycles. Reverse cycles are divided mainly into two categories: compression systems and absorption systems.

With reference to compression systems, they are constituted typically by a closed cycle which contains a working fluid such as an R134a or R22 technical gas, which flows through, in the following order, a compressor, a condenser, a throttling valve or capillary tube, and an evaporator.

In these systems, the condenser operates at a higher pressure than the evaporator: therefore, the working fluid is transferred from the condenser, in the liquid phase, to the evaporator, in the liquid and steam phase, through a dissipation element, such as an orifice, a throttling valve or a capillary tube. Inside said dissipation element, the working fluid passes from a single-phase state (liquid) to a two-phase state (liquid and vapor), dissipating pressure energy. A fraction of lubricating oil, deriving from oil accumulation, for example, inside the compressor, also commonly circulates together with the working fluid.

The background art provides for the utilization of the pressure difference between the condenser and the evaporator by means of an expander for the production of useful power, with the dual goal of reducing the consumption of mechanical energy of the compressor and of reducing the quality (vapor mass fraction with respect to the total mass in liquid and vapor phases) of the working fluid at the inlet of the evaporator, thus increase the available enthalpy difference from evaporator inlet to evaporator outlet. The increase in performance in reverse cycles can be measured by an increase in coefficient of performance (COP). COP is typically defined as the ratio between the heat absorbed by the evaporator and the absolute value of the work that is required by the compressor. Depending on the type and size of application, COP values of reverse cycles may vary in the range 2 to 10, typically. Both the reduction in mechanical energy consumption and the reduction in quality, thanks to the introduction of a turbine between condenser and evaporator, are known to allow an increase of up to 20% of the COP of the reverse cycle.

Among devices known in the background art, in particular, U.S. Pat. No. 4,336,693-A is known which describes a refrigeration apparatus which uses a radial turbine provided with blades to provide the working fluid expansion function, providing a separation of the liquid phase from the vapor phase prior to the extraction of useful work. The useful work can be used to move a load, such as an electric generator.

Patent EP0728996-B1 describes a turbine provided with blades for a two-phase fluid in refrigeration systems that has a fluid bypass feature, in order to improve its performance for partial loads. Furthermore, said turbine can be connected to the compressor of the refrigeration cycle. This patent estimates the following increases in performance: for a 100-1000 tons refrigeration system, using a high-pressure working fluid such as R22 or R134A, and a centrifugal or screw compressor driven by a two-pole induction motor (at 3000 to 3600 rpm), the efficiency of the turbine is estimated equal to 60%. Based on the operating conditions, the turbine reduces the consumption of mechanical energy of the compressor by 6-15%, with respect to the system provided with a throttling valve.

Patent EP 0676600B1 relates to a refrigeration system which includes a turbine instead of the throttling valve, characterized by a rotor with peripheral blades.

U.S. Pat. No. 4,442,682 shows a turbine of the Banki water turbine type, therefore provided with blades, for application to refrigeration systems, in which turbine outlet the vapor fraction of the working fluid is bypassed directly at the evaporator outlet, reducing its load losses.

Patent US20130294890-A1 shows a reverse Brayton cycle provided with a bladeless compressor (boundary layer compressor) for the refrigeration of the cabin of cars. The working fluid is a single-phase gas, preferably air.

Patent CN 203131996-U describes an air conditioner for enclosed spaces in which the throttling valve is replaced with a bladed turbine, which is coupled by means of a magnetic coupling to an electric generator.

In general, it can be stated that the background art acknowledges the difficulties in designing and providing a turbine that can operate instead of the throttling valve in reverse cycles with phase transition of the working fluid.

This difficulty is due mainly to the two-phase nature of the working fluid, which in this point of the system is composed of a liquid fraction and a gas fraction.

The background art also acknowledges the difficulty of a direct coupling between said turbine and the compressor, due to the different rotational speeds.

Although the known solutions indicated above are generally functional, they have however some limitations, which so far have prevented the provision of efficient and reliable turbines in compression refrigeration cycles, in particular:

- erosion of the blades, both fixed (stator) or moving (rotor), caused by the liquid fraction dispersed in the vapor of the two phase fluid (from experience, in steam turbines or in gas turbine compressor fogging systems it is known that however small particles of liquid are entrained by the gaseous fluid in conditions of high speed of the fluid, and it is practically not possible to avoid erosion of the rotor blades);
- the presence, together with the working fluid in the two-phase state, of a third liquid substance, constituted by the oil of the compressor, which must circulate in the system;
- the scale effect, due to the relatively low volumetric flow rate of the fluid in the point of the throttling valve, which entails reduced dimensions for the turbine, with consequent penalization of efficiency.

SUMMARY

The aim of the present disclosure is to overcome the drawbacks of the background art, allowing in particular the effective recovery of the pressure energy in reverse cycles, which is typically dissipated by means of a duct having a reduced passage or by a throttling valve.

The disclosure provides a reverse cycle machine in which pressure energy recovery is provided by means of reliable components which are not, or scarcely, subject to wear and failures or malfunctions.

In particular, the present disclosure solves the problem of the erosion of a turbine operating between the high-pressure part and the low-pressure part of a compression reverse cycle, and crossed, even partially, by the working fluid that arrives from the condenser and is directed to the evaporator of said reverse cycle. This turbine would operate with the working fluid in the multiphase state, two-phase liquid and vapor in the simplest condition, also mixed with any oil that might arrive from the compressor and is circulating in the cycle. This turbine can process the working fluid for any value of the quality.

Furthermore, the present disclosure solves the problem of performance decay of turbines as the dimensions decrease, and that are significantly reduced in reverse cycles with respect to traditional applications, due to both the reduced mass flow rate of the working fluid and the high density of the processed fluid.

This aim and these and other advantages which will become better apparent hereinafter are achieved by providing a reverse cycle machine according to the corresponding accompanying independent claim, optionally having the characteristics of the dependent claims, which are understood to be an integral part of the present description.

Particularly, the disclosure provides a compression reverse cycle machine, comprising an evaporator, a compressor and a condenser arranged in series each other along a path of a working fluid in the machine, further comprising a boundary layer turbine, placed between the condenser and the evaporator, said turbine comprising a set of power disks mounted on a shaft which rotates inside a volume of a rotor casing, an inlet opening for introducing a working fluid in a stator volume, a stator nozzle, which accelerates the flow in a direction that is tangential to the power disks, a discharge of a working fluid, the rotor casing comprising a drain of a liquid fraction at least of said working fluid from the peripheral part of the power disks in order to avoid its concentration in the peripheral part of the volume of said rotor casing.

The underlying idea of the disclosure is to use a boundary layer turbine, also referred to as friction type or Tesla type turbine, capable of processing a single-phase or multiphase fluid in the absence of rotor blades, optionally coupled to an electric power generator.

Boundary layer machines, and in particular turbines for the generation of useful energy but also pumps or compressors, were patented in 1913 by Nikola Tesla. With particular reference to boundary layer turbines (U.S. Pat. No. 1,061,206), they use rotating flat disks without wing-like profiles or blades or impellers, so much that they are termed "bladeless". Conceptually, the rotor in fact absorbs kinetic energy from the working fluid due to resistance forces (viscous friction) and not due to lift forces, thus utilizing the viscosity and adhesion properties of the fluids. These types of turbines are therefore suitable for working with dense fluids and with high density. Subsequently, improved variations of the boundary layer pump or turbine have been reported especially for operation with complex fluids such as multiphase fluids. In fact, in these boundary layer machines, the dense fraction of a multiphase fluid is not diverted by blades or profiles and therefore the mechanical erosion of the surface is minimal Vice versa, traditional turbines or pumps, provided with blades and profiles for the exchange of work with the fluid, are subject to rapid wear when they are used with a multiphase fluid. Likewise, for the same reasons, significant advantages have been reported in the case of operation with liquids subject to cavitation, which typically leads to a rapid decrease, due to erosion, of the performance of traditional bladed machinery.

The absence of blades or profiles that interact with the fluid furthermore leads to significant advantages in terms of vibrations, since the fluid dynamics forces that excite the vibrations on the rotating shaft in this case are minimized. Furthermore, the problem of vibrations is particularly severe in traditional turbine machines processing a multiphase fluid.

The applicability of boundary layer turbines to multiphase fluids, however, has a limitation linked to the separation of the phases caused by the centrifugal force of the rotor and due to the different density between the phases. This "centrifugation" of the multiphase fluid in fact causes the concentration of the densest phase at the periphery of the rotor.

In the case of a liquid-gas multiphase fluid (two-phase in the simplest meaning), the accumulation of liquid between the peripheral region of the rotor and the external containment casing (wheel chamber) causes the flooding of said rotor, with consequent viscous dissipation of energy. The flow of the liquid phase through the outlet at the center of the rotor, in fact, would require a higher pressure gradient than the one required by the gaseous phase.

The general idea on which the present disclosure is based provides for a compression reverse cycle machine equipped at least with a compressor, at least one evaporator and at least one condenser of the working fluid, and provided with a boundary layer turbine, operating between the high-pressure cycle part and the low-pressure cycle part of the working fluid.

More particularly, the disclosure relates to a machine with compression reverse cycle, comprising an evaporator, a compressor and a condenser arranged in series to each other along a path of a working fluid in the machine, which machine further comprising a boundary layer turbine, operating (and provided) between the condenser and the evaporator, said turbine comprising a set of power disks mounted on a shaft which rotates inside a volume of a rotor casing an inlet opening for introducing the working fluid in a stator volume a stator nozzle, which accelerates the flow in a direction that is tangential to the power disks a discharge of the working fluid the rotor casing comprising a drain of a liquid fraction at least of the working fluid from the peripheral part of the power disks in order to avoid its concentration in the peripheral part of the power disks of the volume of said rotor casing Said boundary layer turbine can process all or a fraction of the flow rate of the working fluid of the reverse cycle machine.

Furthermore, said boundary layer turbine can perform a partial expansion of the working fluid, assigning to another component the task of completing the expansion.

This solution offers the advantage of minimizing the erosion of the turbine, since the turbine has no blades or profiles that would be eroded by the fluid of the single- or multiphase type. In this latter case, the fluid is characterized by a quality that is variable between zero and one. Furthermore, this solution offers the additional advantage of reducing the negative impact of the scale effect on the turbine performance for small dimensions of the rotor (microturbines).

According to an advantageous embodiment, in the reverse cycle described previously, the boundary layer turbine is used to generate useful energy, for example in mechanical form. A generator for the production of electric power can be coupled to said turbine.

This solution offers the advantage of reducing the energy consumption of the reverse cycle, increasing its refrigerating capacity or heat pump thermal output, allowing for a twofold increase in its coefficient of performance (COP).

According to an advantageous embodiment, said boundary layer turbine for application to said reverse cycle is characterized by the presence of at least one drain for the discharge of the liquid fraction of the working fluid on the rotor casing (or wheel chamber). Said drain can connect the volume of the rotor casing to the outlet of the turbine or directly to the evaporator of the reverse cycle.

This solution has the advantage of avoiding the risk of flooding of the peripheral region of the rotor, due to the accumulation of the dense (liquid) fraction of the working fluid and/or of the circulating oil, if present, by centrifugal force. This allows the optimization of turbine performance, reducing viscous losses.

According to an advantageous embodiment, the above-cited discharge drain can be throttled by an apt valve with a variable cross-section in order to adjust the discharged flow rate.

This solution has the advantage of being able to adapt the size of the discharge drain to the operating condition of the reverse cycle, in order to allow the complete evacuation of the liquid fraction from the rotor casing volume without discharging also part of the vapor fraction, thus maximizing the vapor fraction of the working fluid that flows through the power disks.

According to an advantageous embodiment, the turbine has at least one rotating sealing disk, characterized by an outside diameter that is smaller than the outside diameter of said power disks and of a sealing stator element inside which it rotates; said power disks are provided with axial discharge holes, the rotating sealing disk being provided with axial discharge holes in continuity with the discharge holes of the power disks.

Preferably, the discharges of said turbine furthermore comprise radial holes for discharge and discharge passages.

Said sealing disk is furthermore characterized by apt axial-symmetrically shaped portions in order to hinder the leakage of the working fluid from the wheel chamber to the discharge holes of the turbine.

According to an advantageous embodiment, said boundary layer turbine is of the "impulse" type, in order to maximize the vapor fraction in output from the stator and at the inlet of the power disks and to minimize the leakage flow rate through the periphery of the sealing disk, such leakage flowing from the peripheral region of the rotor to the discharge holes. This solution has the advantage of maximizing the power generated by the turbine and of reducing losses due to leakage.

The disclosure provides also for a first method for adjusting said reverse cycle by means of a bypass of the working fluid around said boundary layer turbine in order to provide the complete outflow of the liquid fraction of the working fluid through said discharge drains of the wheel chamber, without however discharging the vapor fraction, also when the operating condition of the reverse cycle varies. This solution offers the advantage of minimizing the contact of the liquid fraction of the working fluid with the rotor and also of maximizing the vapor fraction of the working fluid portion passing through the rotor, with a benefit in terms of efficiency of expansion and of generated useful power.

The above cited advantage can be achieved also by means of a second method for adjusting said reverse cycle by means of a throttling valve placed upstream or downstream of the boundary layer turbine, or with both valves present, in order to provide the complete outflow of the liquid fraction of the working fluid through said discharge drains of the wheel chamber, without however discharging the vapor fraction, also when the operating condition of the reverse cycle varies.

This advantage can also be achieved by means of a third method for the adjustment of said reverse cycle, by throttling the discharge drain by a valve in order to provide the complete outflow of the liquid fraction of the working fluid through said drains, without however draining the vapor fraction, also when the operating condition of the reverse cycle varies.

In one preferred and advantageous embodiment, the three adjustment methods cited above can be present alternately in pairs or all three simultaneously.

Further advantageous characteristics are the subject matter of the accompanying claims, which are understood to be an integral part of the present description.

BRIEF DESCRIPTION OF THE DRAWINGS

The disclosure is described hereinafter with reference to nonlimiting examples, provided with a nonlimiting explanatory purpose in the accompanying drawings. These drawings illustrate different aspects and embodiments of the disclosure and, where appropriate, reference numerals that illustrate structures, components, materials; elements that are similar in different figures are designated by similar reference numerals.

In the accompanying figures.

DETAILED DESCRIPTION OF THE DRAWINGS

Figure 1:
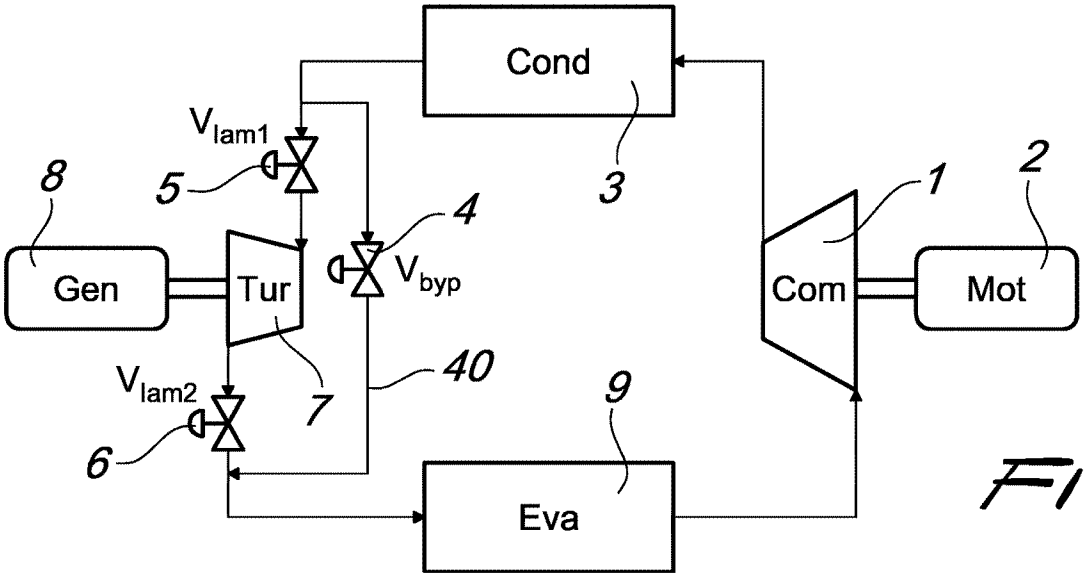
FIG. 1 is a view of a reverse cycle with at least one compressor, one evaporator and one condenser, in which the expansion of the working fluid from the high-pressure part of the system (condenser) to the low-pressure part of the system (evaporator) occurs, even partially, by means of a boundary layer turbine.

While the disclosure is susceptible of various modifications and alternative constructions, some preferred embodiments are shown in the drawings and are described hereinafter in detail.

It is to be understood in any case that there is no intention to limit the disclosure to the specific illustrated embodiment, but, on the contrary, it intends to cover all the modifications, alternative constructions, and equivalents that fall within the scope of the disclosure as defined in the appended claims.

The use of "for example", "etc.", "or" indicates nonexclusive alternatives without limitation unless otherwise specified.

The use of "includes" means "includes, but is not limited to" unless otherwise specified.

Indications such as "vertical" and "horizontal", "upper" and "lower" (in the absence of other indications) are to be read with reference to the assembly (or operating) conditions and with reference to the normal terminology in use in everyday language, where "vertical" indicates a direction that is substantially parallel to the direction of the vector of the force of gravity "g" and "horizontal" indicates a direction that is perpendicular thereto.

With reference to the reverse cycle shown in FIG. 1, which uses a working fluid, for nonlimiting example, of the R134a or R22 type, the compressor (1), driven by a motor (2) for example of electrical type, sends the working fluid from the low-pressure region, in which the evaporator (9) is present, to the high-pressure region, in which the condenser (3) is present. From said condenser, the working fluid traditionally passes through an expansion element (throttling valve or capillary tube) to enter the evaporator. In the present disclosure, the working fluid passes, even partially, through a boundary layer turbine (7) in order to produce useful work.

Figure 2B:
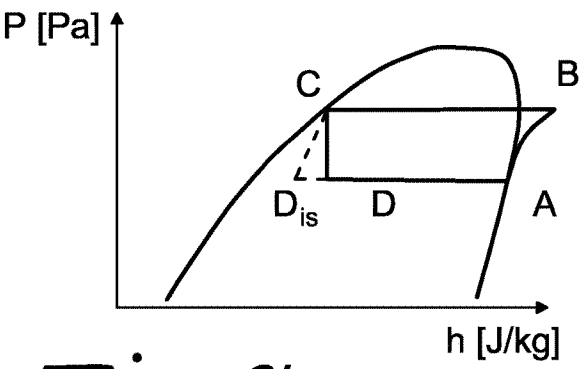
FIGS. 2*a* and 2*b* show, respectively, the temperature(T)-entropy(S) and pressure(P)-enthalpy(H) thermodynamic reference charts for the reverse cycle; the charts plot both the traditional cycle (points ABCD) and the one with an ideal turbine, i.e. providing an isoentropic adiabatic expansion of the whole working fluid flow rate (points $ABCD_{is}$)
Figure 2A:
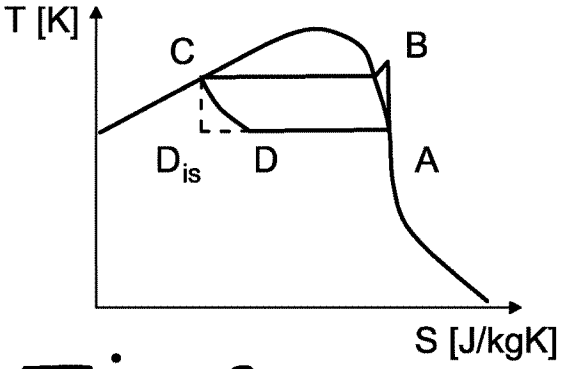

Said turbine (7) can be connected to an electrical generator (8) for the generation of electric power. Said useful work or electrical power partially compensates the consumption of work or electrical power of the compressor, thus reducing the overall energy consumption and increasing the COP. Said boundary layer turbine (7) works with a multiphase fluid, optionally two phase in the simplest case. With reference to FIG. 2*a*, 2*b* and to traditional reverse cycles, the fluid performs the A-B transformation in the compressor and then performs the B-C transformation in the condenser and then performs the isoenthalpic transformation C-D in the throttling element, to then close the cycle with the D-A transformation in the evaporator.

In the case of the present disclosure, the fluid in output from the condenser is sent to the boundary layer turbine (7). Ideally, this turbine might perform an isoentropic reversible transformation, represented between the points C-$D_{is}$. However, the actual expansion transformation will be characterized by an isoentropic adiabatic efficiency lower than 100% (that is the case of an ideal transformation), and therefore the actual transformation will be comprised between the ideal one C-$D_{is}$ and the fully dissipative one of the isoenthalpic type C-D. This brings the following two advantages: the recovery of useful energy, which can be used to reduce the energy consumption of the compressor; the increase of the enthalpy difference available at the evaporator, with a consequent increase in refrigerating or heat pumping capacity. Both advantages entail an increase of COP with respect to the initial reverse cycle without the boundary layer turbine: the energy recovery in fact allows the reduction of the denominator of the COP, compensating the work spent for compression, while the enthalpy difference increase at the evaporator allows an increase of equal amount of the numerator of the COP.

Figure 4:
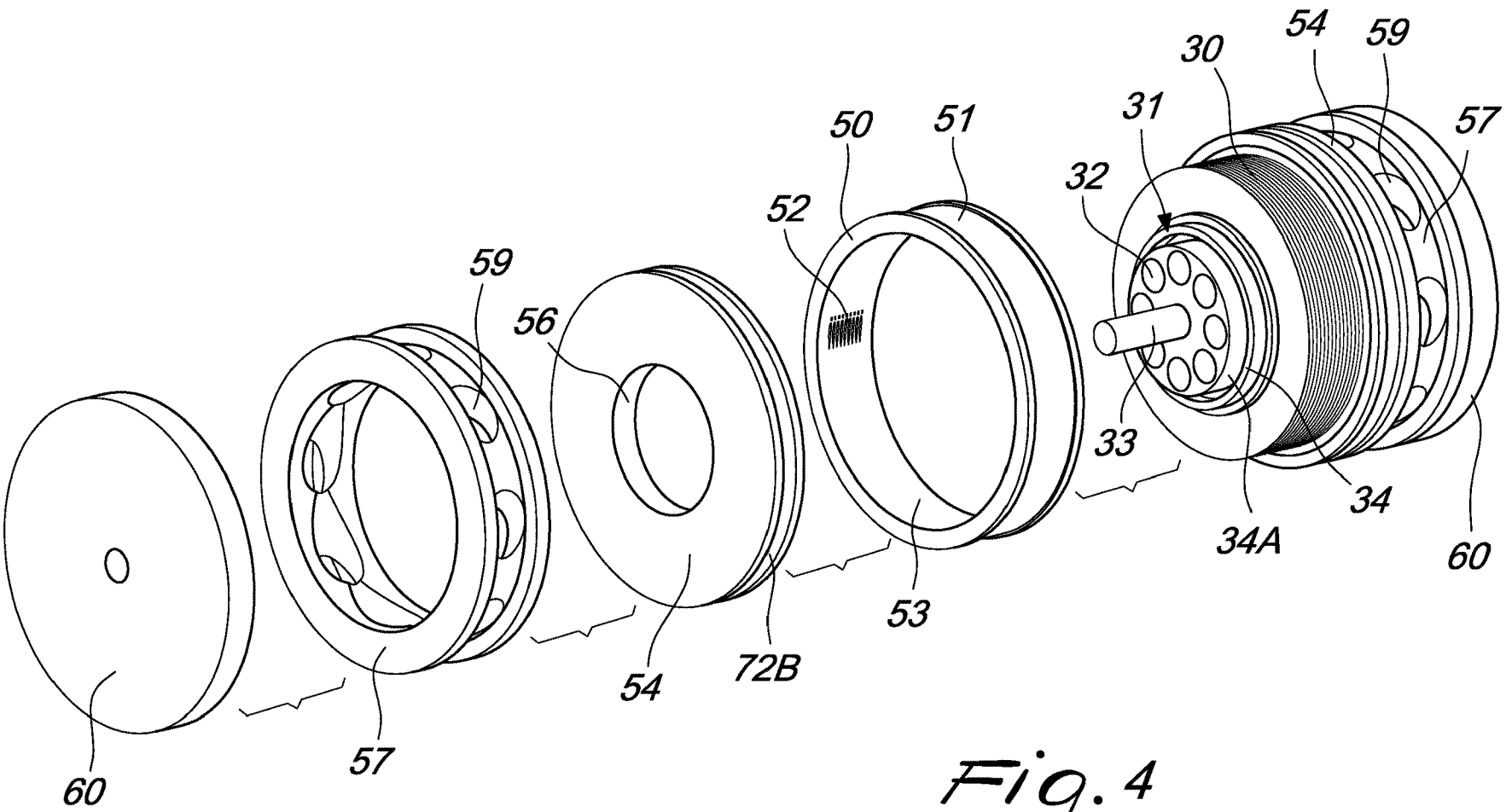
FIG. 4 is an exploded view of an example of a boundary layer turbine for application to reverse cycles; the turbine is drawn, by way of example, symmetrical with respect to the centerline.

Following the path of the working fluid inside the boundary layer turbine, the working fluid is fed at high pressure through apt inlet openings (70) in the stator volume. Said stator volume is represented by a volume that is defined by the external enclosure of the turbine (75) and an internal ring (50), in which an appropriate slot for the passage of the pressurized fluid has been provided. In FIG. 4, as a nonlimiting example, said stator volume (51) coincides with the volume of said slot. Said ring (50) therefore forms externally the stator volume (51) and internally the rotor casing or wheel chamber (53). Inside the rotor casing there is the moving element of the turbine, which is capable of extracting useful work from the fluid. Said moving element is represented by a rotating shaft (33) on which power disks (30) are rigidly mounted and are mutually spaced (interstitial space) along the shaft axis: the number of the power disks is at least equal to two. The working fluid passes from the stator volume to the wheel chamber by passing through appropriate stator nozzles (52), which accelerate the flow in a direction that is approximately tangential to the power disks (30).

Stator nozzles (52) are provided in the ring (50) as through holes connecting the stator volume (51) with the rotor casing (53) itself.

The acceleration of the fluid occurs at the expense of the pressure energy, which is reduced from the stator volume to the wheel chamber. Due to said pressure reduction, the fluid increases its vapor fraction and decreases the liquid fraction: the liquid fraction can include also the lubricating oil that circulates in the reverse cycle. The vapor fraction is forced to pass through the interstitial space between the power disks, until discharge occurs through apt axial holes in the disks (35); rotor axial discharge holes (35) are provided in each power disk (30) close to the central part of the disk itself, near the rotating shaft (33).

The fluid exchanges useful work with the power disks (30) thanks to the tangential friction forces and is therefore slowed tangentially by said disks, until it exits through said rotor axial discharge holes (35).

Said rotor axial discharge holes (35) are aligned with the sealing disk axial discharge holes (32). Such sealing disks, placed on the opposite sides of the set of power disks, are pressed against the set of power disks, with no interstitial space: the fluid is therefore discharged first through the rotor axial discharge holes (35), then through the sealing disk axial discharge holes (32) provided in the sealing disk (31), and finally through the discharge ring radial holes (59) provided in the fixed discharge ring (57), to be finally collected and sent externally the enclosure (75) through the radial discharge passages (73, 74) provided in the enclosure (75) itself.

In said rotor axial discharge holes and sealing disk axial discharge holes (35, 32) the pressure is lower than the pressure at the power disk periphery and, except for small pressure losses, equal to the final discharge pressure of the turbine (at the discharge passages 73, 74). Therefore, on the two power disk surfaces facing the two opposite sealing stator elements (54), at both sides of the set of the power disks, it is important to limit the leakage losses of the working fluid from the periphery of the power disks to the rotor axial discharge holes (35) and sealing disk axial discharge holes (32).

This sealing effect is provided by the sealing disk (31), which is characterised by appropriate axial-symmetrical slots (34A) in order to hinder the leakage of the working fluid; preferably the sealing disk (31) is provided at least with an annular lip (34) that is engaged in a corresponding seat (54A) of the surrounding sealing stator element (54).

Said sealing disk (31) can be provided by a monolithic part, or by means of the assembly of multiple disks having a definite thickness: in both cases, the sealing disk (31) is characterized by outside diameters of every part of the sealing disk (31) that are smaller than the corresponding inside diameter of the respective part of the sealing stator element (54) within which it rotates, preferably smaller than 0.3%, and smaller than the diameter of the power disks (30), in order to minimize the aforementioned leakage losses.

In other words, the radial distance between the sealing disk (31) and the sealing stator element (54) is preferably smaller than 0.3% of the corresponding diameter.

Like the power disks (30), said sealing disk (31) is mounted rigidly on the rotating shaft (33).

The liquid fraction that is still present after expansion through the stator nozzles (52), instead, follows two alternative paths: to a minimal extent, it is entrained by the vapor fraction to the discharge of the turbine, and for the most part it is confined in the rotor casing, at the power disk periphery, due to the centrifugal force.

In order to evacuate said liquid fraction from the rotor casing, discharge drains (71, 72) are provided on the wall of the wheel chamber in order to collect the liquid fraction and convey it outside the enclosure of the turbine.

Particularly, said drains (71,72) are drains provided in the peripheral portion of the rotor casing (53); more in detail, the drain passage comprises a first drain portion (71A,72A) provided as a duct in the peripheral portion of said sealing stator element (54), in fluid communication with a second drain portion (71B,72B) provided in the sealing stator element (54) as a circumferential or annular channel that, in use, faces the internal wall of the housing (75) and that is on its turn in fluid communication with the hole in the housing (75).

By way of example, said drains (71,72) can convey the liquid fraction toward the general discharge of the turbine (73) or, in other embodiments, directly toward the evaporator (9) of the reverse cycle.

Discharge drain (71, 72) are preferably throttled by respective valves (not shown).

This allows to avoid the flooding of the peripheral part of the power disks, with consequent losses due to the viscous effect.

Finally, the enclosure of the turbine (75) can be closed by plugs (60) at the ends, which can accommodate apt bearings to allow the rotation of the rotating shaft (33).

It is possible to mechanically connect the compressor (1) of the reverse cycle to said rotating shaft, in order to reduce its energy consumption.

In another preferred configuration, a generator (8) for the generation of electrical power is connected to said rotating shaft.

Figure 5:
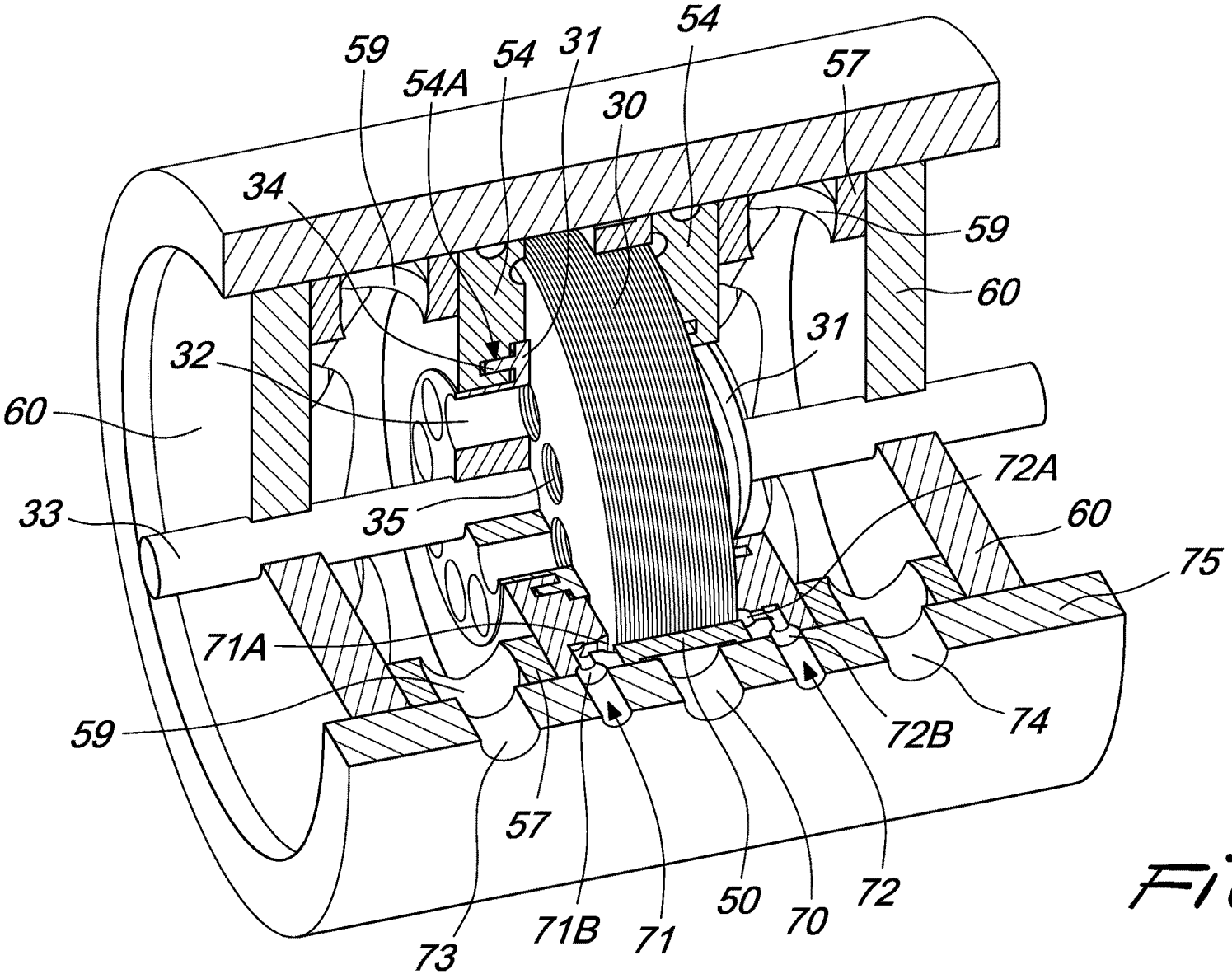
FIG. 5 is a cutout view of the assembly of the boundary layer turbine of FIG. 4.

Summarizing, the turbine (7), as shown in FIGS. 4 and 5 in a preferred embodiment, comprises preferably a symmetrical structure in which are provided at least:

a turbine enclosure (75) defining an interior volume two mutually facing and opposed plugs (60), for closing the interior volume of the turbine enclosure (75) at opposite sides a rotating shaft (33) passing in the interior volume and projecting outside the plugs (60), said turbine enclosure (75) being provided with:

a radial inlet (70) for a pressurized fluid drains (71,72), discharge passages (73, 74);

inside said interior volume of the turbine enclosure (75) being provided at least:

an internal ring (50), with an external annular slot for the passage of the pressurized fluid, defining an internal wall of the turbine enclosure (75), a stator volume (51), said ring (50) defining internally a rotor casing (53); said internal ring (50) being provided with stator nozzles (52) connecting the stator volume (51) with the rotor casing (53), a set of power disks (30) housed in said rotor casing (53) and coupled to said rotating shaft (33), a first and a second rotating sealing disks (31) provided at opposite faces of said set of power disks (30) and coupled with said rotating shaft (33), said power disks (30) being provided with rotor axial discharge holes (35), said sealing disks (31) being provided with axial discharge holes (32) aligned with said rotor axial discharge holes (35), a first and a second fixed (non rotating) sealing stator element (54) surrounding at least a portion of respectively said first and second sealing disk (31), said rotating sealing disk (31) being concentric with respect to the power disks (30) and having an outside diameter that is smaller than the outside diameter of said power disks (30) and being provided with an annular lip (34) engaging a corresponding seat of the sealing stator element (54), a first and a second discharge ring (57) provided between said first and second sealing stator element (54) and said plugs (60), said first and second discharge ring (57) being provided with radial discharge ring holes (59), said sealing disk axial discharge holes (32) being in fluid communication with said radial discharge ring holes (59), said radial discharge ring holes (59) being in fluid communication with said discharge passages (73, 74) of the turbine enclosure (75).

In this embodiment, said drains (71,72) are drains provided in the peripheral portion of the rotor casing (53) as above described.

In another embodiment (that can be seen as a basic embodiment), the turbine (7) does not show a symmetrical structure, and the turbine (7) comprises:

a turbine enclosure (75) defining an interior volume two mutually facing and opposed plugs (60), for closing the interior volume of the turbine enclosure (75) at opposite sides a rotating shaft (33) passing in the interior volume and projecting outside the plugs (60), said turbine enclosure (75) being provided with:

a radial inlet (70) for a pressurized fluid drains (71), discharge passages (73);

inside said interior volume of the turbine enclosure (75) being provided at least:

an internal ring (50), with an external annular slot for the passage of the pressurized fluid, defining, with an internal wall of the turbine enclosure (75), a stator volume (51), said ring (50) defining internally a rotor casing (53); said internal ring (50) being provided with stator nozzles (52) connecting the stator volume (51) with the rotor casing (53), a set of power disks (30) housed in said rotor casing (53) and coupled to said rotating shaft (33), a rotating sealing disk (31) provided at one face of said set of power disks (30) and coupled with said rotating shaft (33), said power disks (30) being provided with rotor axial discharge holes (35), said sealing disk (31) being provided with sealing disk axial discharge holes (32) aligned with said rotor axial discharge holes (35), a sealing stator element (54) surrounding at least a portion of said rotating sealing disk (31), said rotating sealing disk (31) being concentric with respect to the power disks (30) and having an outside diameter that is smaller than the outside diameter of said power disks (30) and being provided with an annular lip (34) engaging a corresponding seat of the sealing stator element (54), a discharge ring (57) provided between said sealing stator element (54) and said plug (60), said discharge ring (57) being provided with radial discharge ring holes (59), said sealing disk axial discharge holes (32) being in fluid communication with said radial discharge ring holes (59), said radial discharge ring holes (59) being in fluid communication with said discharge passage (73) of the turbine enclosure (75).

In this embodiment, said drain (71) is a drain provided in the peripheral portion of the rotor casing (53) as above described.

Consider a reverse cycle, which utilizes R134a as working fluid and operates between the conditions at the evaporator (9) of 4 bar and 8.9° C. and the conditions at the condenser (3) of 16 bar and 57.9° C.; adopt the typical convention of thermodynamics, for which the positive sign is associated with the heat provided to the cycle (or absorbed by the cycle) and to the work produced by the cycle; let the coefficient of performance (COP) be the ratio between the heat absorbed by the evaporator and the absolute value of the work that is required in total by the cycle. In the case of a traditional reverse cycle, i.e. with a dissipative expansion device such as a throttling valve, assuming an isentropic adiabatic efficiency in compression equal to 80%, a COP equal to 1.98 is obtained. If the flow rate of working fluid is equal to 2 kg/s, the power absorbed by the compressor (1) is −119.3 kW. If the boundary layer turbine (7) according to the present disclosure is installed in place of the throttling valve, the power consumed in total to the reverse cycle is reduced and the COP increases, as shown in the table below, as the isoentropic adiabatic efficiency of the turbine varies.

| | Throttling valve | Turbine with ηis = 100% | Turbine with ηis = 70% | Turbine with ηis = 40% |
|---|---|---|---|---|
| Pcompr [kW] | −119.3 | −119.3 | −119.3 | −119.3 |
| Pturb [kW] | 0.0 | 13.4 | 9.4 | 5.4 |
| Pabsorbed [kW] | −119.3 | −105.8 | −109.9 | −113.9 |
| Qcond [kW] | −355.9 | −355.9 | −355.9 | −355.9 |
| Qeva [kW] | 236.6 | 250.0 | 246.0 | 242.0 |
| COP | 1.98 | 2.36 | 2.24 | 2.13 |
| COP variation | — | +19% | +13% | 7.00% |

Figure 3:
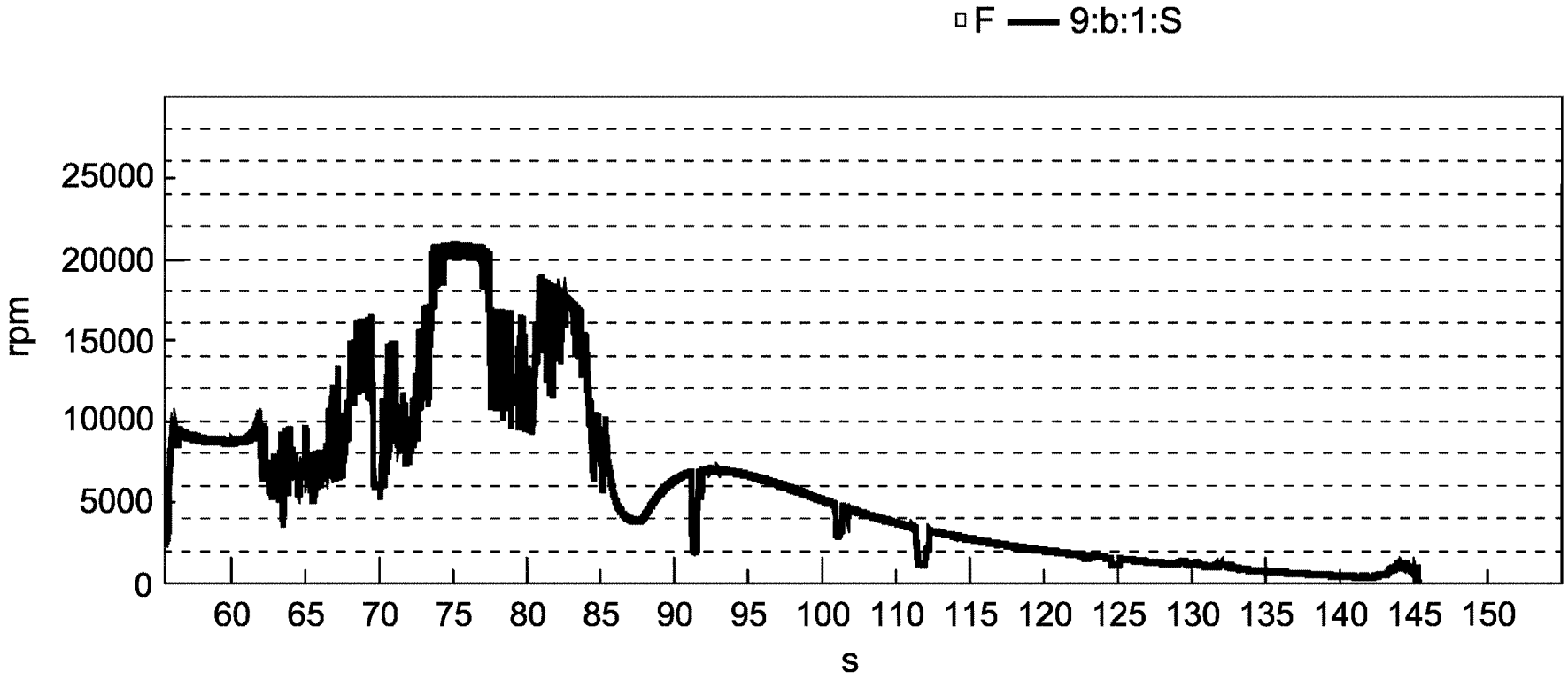
FIG. 3 plots the speed of a boundary layer turbine shaft inserted in a prototype reverse cycle, for refrigeration applications, during a transient from the startup to the shutdown of the entire reverse cycle.

The use of the boundary layer turbine instead of the throttling valve, together with the possibility of energy recovery has been demonstrated experimentally by means of a prototype: FIG. 3 shows the detected rotational speed of the boundary layer turbine during a power-on and power-off test of the prototype reverse cycle.

The aim and objectives listed above are thus achieved.

Numerous variations to what has been described so far are obviously possible.

For example, with reference to FIG. 1, the working fluid that arrives from the condenser of the reverse cycle and is directed to the turbine can be diverted partially or fully through the adjustment bypass valve (4), in order to optimize the performance of the turbine as the operating conditions of the reverse cycle vary. Also, for example, the turbine might perform a partial expansion of the working fluid. Also, for example, the working fluid can be throttled upstream or downstream of the turbine by means of appropriate adjustment throttling valves (5, 6). These valves (4, 5, 6) can be present individually or in pairs or all three simultaneously. The use of these adjustment valves, as the operating conditions of the reverse cycle vary, allows the correct outflow of the liquid fraction of the working fluid from the wheel chamber to the outlet of the turbine through the discharge drains (71, 72), avoiding both the flooding of the peripheral part of the power disks (30) with consequent viscous losses and the maximization of the vapor fraction in the working fluid portion flowing through the rotor, which vapor fraction otherwise might partially leak through said discharge drains (71, 72). Moreover, for example, the flooding of the wheel chamber or the passage of a part of the vapor fraction through the discharge drains (71, 72) can be avoided by adjusting properly the passage section of said discharge drains (71, 72), in order to adjust the mass flow rate of working fluid drained from the wheel chamber (53).

As a further example, with reference to FIG. 4, the outside diameter of the wheel chamber (53) can be any one greater than the outside diameter of the power disks (30), without necessarily causing the wheel chamber to contain as precisely as possible said power disks, i.e., with minimal radial gap between the wheel chamber and the power disks.

As a further example, with reference to FIG. 5, the sealing disk (31) can have both radial-symmetrical slots and axial-symmetrical slots, or only one of the two options, in order to hinder the passage of working fluid from the periphery of the power disks to the discharge holes (35, 32, 59).

As a further example, with reference to FIG. 5, the sealing disk (31) has an outside diameter that is smaller than the inside diameter of the sealing rotor element (54) within which it rotates.

As a further example, with reference to FIG. 1, the boundary layer turbines might be more than one, arranged in series or in parallel from the point of view of the working fluid. Said turbines might process all or a fraction of the flow rate of the working fluid. Likewise, all or only some of the adjustment valves (4, 5, 6), as well as the adjustment of the cross-section of the discharge drains (71, 72), might be repeated for each turbine. Furthermore, the compression of the working fluid might occur in more than one compressor (1), arranged in a series or parallel configuration from the point of view of the working fluid.

The disclosures in Italian Patent Application No. 102016000132467 (UA2016A009642) from which this application claims priority are incorporated herein by reference.

The invention claimed is:

1. A reverse compression cycle machine comprising: an evaporator, a compressor and a condenser arranged in series each other along a path of a working fluid in the machine, further comprising a boundary layer turbine, placed between the condenser and the evaporator, said turbine comprising a set of power disks mounted on a rotating shaft which rotates inside a volume of a wheel chamber, an inlet opening for introducing a working fluid in a stator volume, an internal ring forming externally the stator volume with an external enclosure of the turbine and delimiting internally the wheel chamber, a stator nozzle provided in the internal ring, which accelerates the flow in a direction that is tangential to the power disks, a discharge passage of a working fluid provided in the external enclosure of the turbine, the wheel chamber being further delimited laterally by two sealing stator elements, and comprising at least one drain of a liquid fraction at least of said working fluid from the peripheral part of the power disks in order to avoid its concentration in a peripheral part of the volume of said wheel chamber, wherein said at least one drain is arranged in the sealing stator elements and provided on a wall of the wheel chamber.

2. The reverse compression cycle machine according to claim 1, further comprising a bypass circuit arranged in parallel to said turbine.

3. The reverse compression cycle machine according to claim 1, further comprising a first throttling valve and a second throttling valve which are placed, respectively, upstream and downstream of said turbine in a flow direction of a working fluid in said reverse compression cycle machine.

4. The reverse compression cycle according to claim 1, further comprising a generator for generating electrical power, which is coupled to said turbine.

5. The reverse compression cycle according to claim 1, wherein said at least one drain is throttled by a valve, in order to adjust its discharged flow rate.

6. The reverse compression cycle according to claim 1, wherein said turbine comprises a rotating sealing disk provided at at least one face of said set of power disks and coupled with said rotating shaft, said set of power disks being provided with rotor axial discharge holes, said rotating sealing disk being provided with sealing disk axial discharge holes aligned with said rotor axial discharge holes, one of said two sealing stator elements surrounding at least a portion of said rotating sealing disk, said rotating sealing disk being concentric with respect to said set of power disks and having an outside diameter that is smaller than the outside diameter of said set of power disks and being provided with an annular lip engaging a corresponding seat of said one of said two sealing stator elements, a discharge ring provided between said one of said two sealing stator elements and a plug, said discharge ring being provided with radial discharge ring holes, said sealing disk axial discharge holes being in fluid communication with said radial discharge ring holes, said radial discharge ring holes being in fluid communication with said discharge passage of said external enclosure of said turbine a turbine enclosure.

7. A method for adjusting the reverse compression cycle machine according to claim 1, comprising the provision, in said turbine, of a complete outflow of a liquid fraction at least of said working fluid through said at least one drain of said wheel chamber.

* * * * *